United States Patent [19]

Woodward et al.

[11] 4,315,344

[45] Feb. 16, 1982

[54] VACUUM CLEANER WITH IMPROVED COMPRESSED AIR MEANS

[75] Inventors: James C. Woodward, Elizabethtown; Marion D. Holland, Cox's Creek, both of Ky.

[73] Assignee: Robert E. Robbins, Elizabethtown, Ky.

[21] Appl. No.: 178,478

[22] Filed: Aug. 15, 1980

[51] Int. Cl.[3] ..... A47L 5/14

[52] U.S. Cl. ..... 15/345; 15/404; 15/415 R

[58] Field of Search ..... 15/345, 346, 415 R, 15/416, 418, 420, 404

[56] References Cited

U.S. PATENT DOCUMENTS

| | | | |
|---|---|---|---|
| 1,785,675 | 12/1930 | Cundiff | 15/415 X |
| 2,321,648 | 6/1943 | Brunner | 15/404 |
| 2,475,808 | 7/1949 | Storm | 15/346 |
| 2,867,836 | 1/1959 | Duff | 15/404 |
| 3,107,386 | 10/1963 | Mandin | 15/404 X |
| 3,268,942 | 8/1966 | Rossnan | 15/346 |
| 4,207,650 | 6/1980 | Crise | 15/404 |

FOREIGN PATENT DOCUMENTS

| | | | |
|---|---|---|---|
| 972510 | 8/1975 | Canada | 15/346 |
| 1542802 | 9/1968 | France | 15/346 |
| 639519 | 12/1978 | U.S.S.R. | 15/345 |

*Primary Examiner*—Chris K. Moore

*Attorney, Agent, or Firm*—Richard L. Caslin

[57] ABSTRACT

A vacuum cleaning machine comprising a hood forming a traveling vacuum chamber with an optimum combination of suction nozzle means and jet stream means for projecting a plurality of individual jet streams at a flat angle with the surface that is to be cleaned. A low ceiling plate is positioned between the suction nozzle means and the jet stream means so as to restrict the effective volume of the area that is acted upon by the jet stream means and the suction nozzle means. Associated with the low ceiling plate are a plurality of vertical partitions which divide the area into a series of narrow wind tunnels connecting the jet stream manifold to the intake of the suction nozzle means. A motor driven compressor is positioned above the low ceiling plate and provided with a conduit to deliver a compressed fluid to the jet stream manifold.

7 Claims, 3 Drawing Figures

VACUUM CLEANER WITH IMPROVED COMPRESSED AIR MEANS

BACKGROUND OF THE INVENTION

1. Field of the Invention

This invention relates to vacuum cleaners for household or industrial use for removing foreign matter, dust and debris from floor or carpet surfaces, and particularly those cleaners which provide jet air means for dislodging or agitating the soil and conveying it toward the vacuum means.

2. Description of the Prior Art

An early patent in this art is Farnsworth U.S. Pat. No. 1,281,925 which describes a vacuum cleaner with an inlet opening and a suction-creating, motor/blower wheel or fan that conveys the soil-laden air from the floor or carpet to a porous cleaner bag or filter bag. A second porous cleaner bag or filter bag surrounds the first bag, and part of the air in the second bag is returned to the vicinity of the inlet opening where a blast of air is directed down into the inlet opening to dislodge or agitate the soil on the floor or in the carpet. Thus a partial air recirculating system is provided.

The Hornschuch et al U.S. Pat. No 3,161,900 describes a vacuum cleaning head for use with mining apparatus around mine shafts and drilling sites. The head is equipped with a high pressure air blast which is operable to impart a velocity to objects heavier than dust so that they may be collected by an integral vacuum device.

The Lake et al U.S. Pat. No. 3,328,827 describes a hand-held, air-operated vacuum cleaner for use around gasoline stations that are equipped with high pressure air hoses for use in inflating automobile tires. Such a high pressure air hose is connected to this Lake vacuum cleaner, and the air pressure drives an air turbine that in turn drives a suction fan. The air turbine and the suction fan are both mounted on a common shaft. This vacuum cleaner has a suction head having outwardly disposed forced air discharge ports and a central suction passage.

The Hilbig U.S. Pat. No. 3,678,534 describes a vacuum system for cleaning some surfaces having insoluble dirt particles or coatings firmly attached thereto or embedded therein. One such surface is an acoustical panel having a honeycomb core covered on one side with a thin, imperforate facing sheet and on the other side by a similar facing sheet having a multiplicity of small perforations. The vacuum cleaner head has a high pressure air line with jets of air moving at supersonic speeds. The jet streams dislodge stubborn dirt particles for removal by a vacuum line communicating with the cleaner head.

The Mac Farland U.S. Pat. No. 3,825,972 describes a shag rug rake attachment for mounting on the cleaning nozzle of a vacuum cleaner for combing deep pile shag rugs.

The Haldeman U.S. Pat. No. 3,963,515 describes a conventional vacuum cleaner suction nozzle typically used for cleaning streets or carpets with a plurality of vortex generating air nozzles supported from the nozzle and directed downward ahead of the suction nozzle.

The Rose et al U.S. Pat. No. 4,037,290 describes an institutional or commercial vacuum cleaner having a downwardly facing hood to form a travelling chamber. An air jet nozzle is positioned within the hood, and the nozzle is moved in a circular horizontal orbit by a variable speed motor. A pump is attached to the hood to maintain a vacuum therein.

OBJECTS OF THE PRESENT INVENTION

A principal object of the present invention is to provide a vacuum cleaning machine with a vacuum hood or travelling vacuum chamber having an optimum combination of suction nozzle means in conjunction with jet air stream means with wind tunnels of reduced size for each orifice of the jet stream means for improved efficiency.

A further object of the present invention is to provide a vacuum cleaner machine of the class described with an electrically driven miniature air compressor located near the jet air stream means within the vacuum hood.

A further object of the present invention is to provide a vacuum cleaner machine of the class described with a low-lying shroad connecting the jet air stream means with the vacuum intake so as to reduce the needed volume of compressed air for rendering the soil airborne.

A further object of the present invention is to provide a vacuum cleaner machine of the class described with a low ceiling plate connected between the jet stream means and the suction nozzle means for reducing the effective volume of the area acted upon by the jet stream means and the suction nozzle means.

A further object of the present invention is to provide a vacuum cleaner machine of the class described wherein a motor driven compressor is positioned within the hood and above the low ceiling plate for providing compressed air to the jet stream means.

A still further object of the present invention is to provide a vacuum cleaner machine of the class described where the low ceiling plate is provided with vertical partitions that extend from the jet stream means to the suction nozzle means and create narrow wind tunnels where both the height and the width of the tunnels are tapered or reduced from the jet stream means to the intake of the suction nozzle means.

SUMMARY OF THE INVENTION

The present invention provides a vacuum cleaning apparatus having hood means that is supported on and movable along a surface to be cleaned. The bottom of the hood has an opening that confronts the said surface to form therewith a traveling vacuum chamber. Located within the vacuum chamber is a suction nozzle means that has an outlet that is connected to a vacuum source. A jet stream manifold is positioned generally across the vacuum chamber and it is provided with a plurality of orifices which are directed at a flat angle with the surface that is to be cleaned and generally toward the intake of the suction nozzle means. A low ceiling plate joins the jet stream manifold with the suction nozzle means, and partitions are suspended from the ceiling plate generally between adjacent orifices so as to form narrow wind tunnels that connect the jet stream manifold to the intake of the suction nozzle means. A motor driven compressor is positioned above the ceiling plate and it is provided with a conduit to deliver a compressed fluid to the jet stream manifold.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
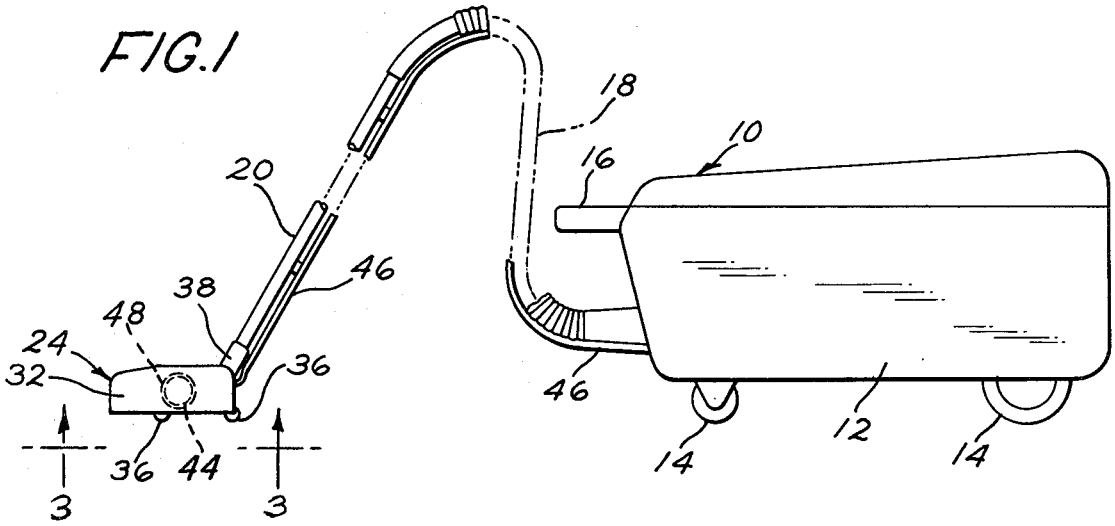
FIG. 1 is a side elevational view of a canister-type vacuum cleaning machine having a floor attachment or hood embodying the present invention.

Turning now to a consideration of the drawings and, in particular, to the side elevational view of FIG. 1 there is shown a canister-type vacuum cleaning machine 10 having a floor mounted canister 12 which embodies the usual vacuum motor/blower unit, a renewable filter bag, an electric power cord reel, an manually settable control means for operating the machine. These standard vacuum cleaner elements of a canister-type machine are not illustrated, as they do not form part of the present invention. What is shown are the support wheels 14, and a front handle 16 for ease in carrying the canister from one place to another. Removably attached to the front of the canister is a flexible, vacuum hose 18 of about 10 feet in length. This hose is adapted to be joined with a slip fit to a metal wand 20, which in turn is fitted into a floor attachment or hood 24. It is within this hood 24 that the present invention is located.

Figure 2:
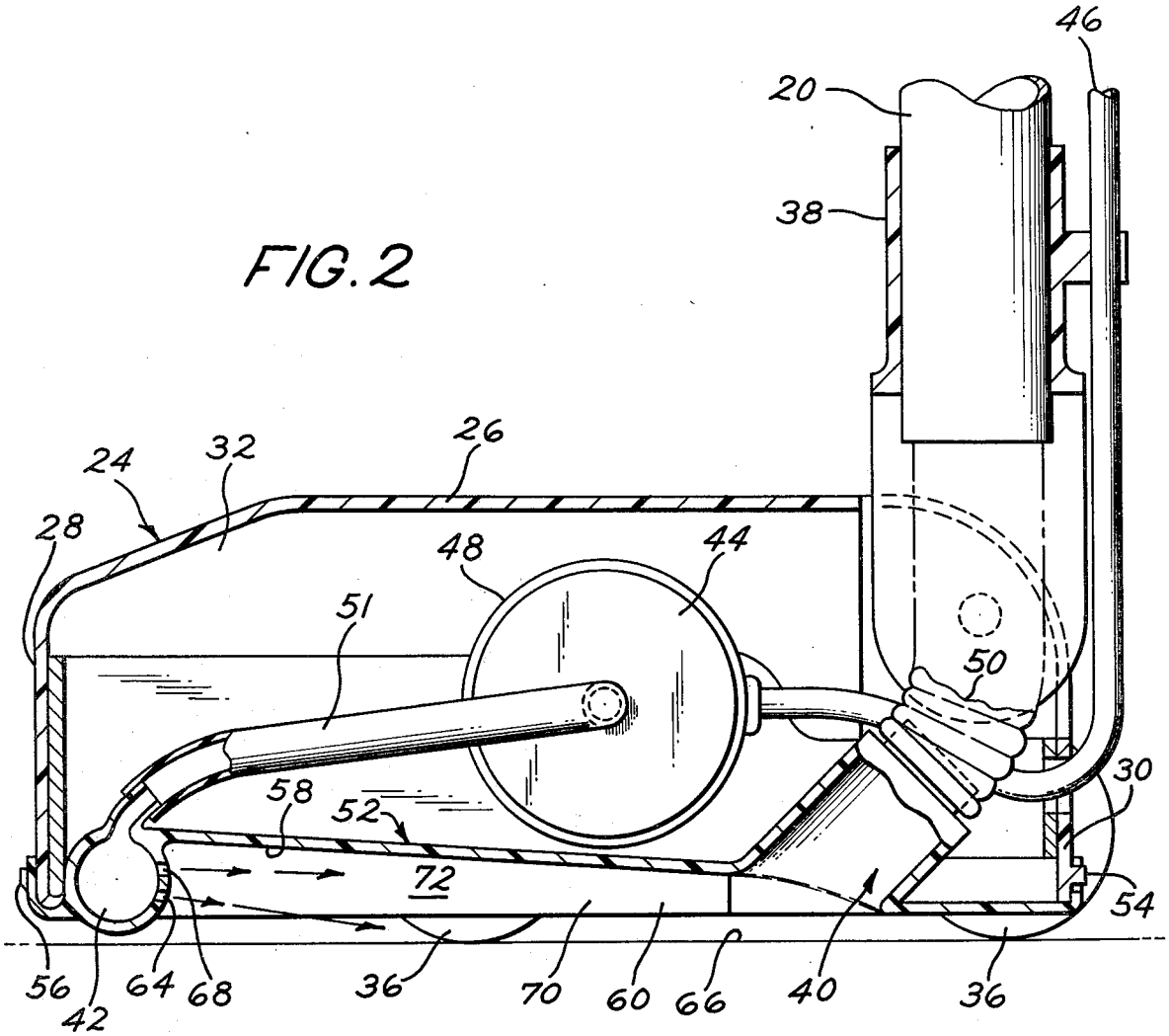
FIG. 2 is a cross-sectional side elevational view on an enlarged scale of the floor attachment or hood of FIG. 1.

FIG. 2 shows the hood 24 in a cross-sectional side elevational view that is taken generally through the center of the hood. The hood 24 is a hollow housing of molded plastic that has a top wall 26, a vertical front wall 28, a vertical rear wall 30, opposite side walls 32 and a generally open bottom wall with a central opening 60. The hood 24 is furnished with a plurality of support wheels 36 for ease in gliding the hood over the floor or carpet surface that is to be cleaned. Certain of these support wheels may be vertically adjustable to adapt the hood to various types of shag or sculptured carpets, or other irregular floor surfaces.

The rear portion of the hood is furnished with a pivoted hollow coupler 38 for receiving the lower end of the metal wand 20 therein, as is conventional in this art. Thus, the wand 20 is capable of pivotal movement between a generally vertical position, as seen in FIG. 2, to a generally horizontal position behind the hood 24.

The hood 24 supports three main elements: namely, a suction nozzle means 40 adjacent the rear, a jet stream means 42 adjacent the front, and a motor driven air compressor 44 in the central area. An electric power cord 46 extends from the canister 12 along the extent of the flexible hose 18 and the metal wand 20, and it is brought in the rear of the hood 24 for connection with the motor 48 for the air compressor 44. Suitable mounting means (not shown) are employed to fasten the motor 48 and air compressor 44 in a suspended position within the hood. A short length of flexible hose 50 joins the pivoted coupler 38 to the suction nozzle means 40.

Figure 3:
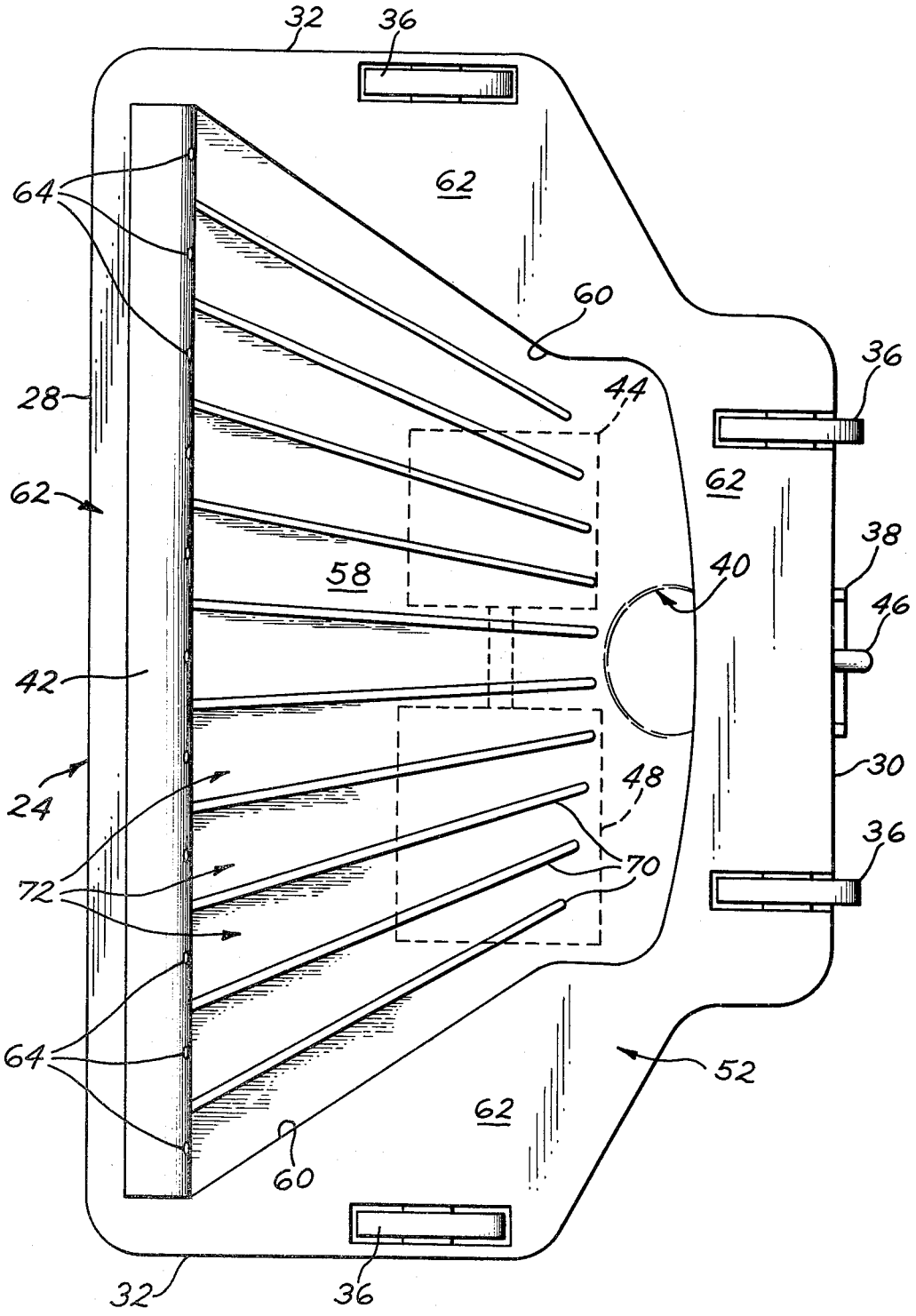
FIG. 3 is a bottom plan view on an enlarged scale of the floor attachment or hood of FIG. 1, taken on the line 3—3 of FIG. 1.

Actually, the suction nozzle means 40 and the jet stream means 42 are formed as part of a single molded plastic plate 52 which has the overall size that fits across the open bottom portion of the hood 24 and is fastened to two or more of the vertical walls of the hood, as for example at 54 at the rear wall 30 and at 56 at the front wall 28. The full nature of this thin molded plastic plate 52 can best be understood with reference to the bottom plan view of FIG. 3. To assist in understanding this FIG. 3, the front wall 28 is at the left side of the Figure and the rear wall 30 is at the right side of the Figure. The four support wheels 36 are illustrated, and the funnel nature of the suction nozzle means 40 is shown towards the rear of the hood 24, while the jet stream means 42 is illustrated as a tubular manifold which extends nearly from one sidewall 32 to the opposite sidewall 32. A short length of hose 51 is fastened at one end to the compressor 44 and at the other end to the tubular manifold 42. This molded plastic plate 52 has a thin, low ceiling plate 58 which is integral with both the manifold 42 and the tapered suction nozzle 40. The periphery of the molded plastic plate 52 is generally planar in nature to form a four-sided horizontal frame 62 around the central opening 60 which underlies the low ceiling plate 58. The front of the plastic plate 52 comprises the tubular manifold 42 and the rear of the plate has the suction nozzle 40. The manifold 42 is provided with a plurality of jet orifices 64 which are directed rearwardly at a flat angle toward the floor or carpet surface 66 to be cleaned.

As is best seen in FIG. 2, a second series of jet orifices 68 may be positioned above the first series 64 and they are directed generally rearwardly and horizontally so as to scavenge or flush out the area of any airborne soil that may be present beneath the low ceiling plate 58. It has been determined that it is advantageous to provide the bottom opening 60 with a plurality of vertical partitions 70 suspended from the low ceiling plate 58 so as to separate the series of jet orifices 66 with a partition 70 between each pair of orifices 64 and provide a narrow wind tunnel 72 for each orifice connecting the jet stream manifold 42 to the intake of the suction nozzle means 40. The nature of these wind tunnels 72 can best be determined by comparing the side view of FIG. 2 with the bottom plan view of FIg. 3. Notice in the bottom plan view of FIG. 3 that the width of the wind tunnels is tapered or reduced from the jet stream manifold 42 to the intake of the suction nozzle 40. Moreover, as is seen in FIG. 2, the height of each wind tunnel 72 is reduced from the jet stream manifold 42 to the intake of the suction nozzle 40. These variations in the size, shape, and volume of the wind tunnels serves to decrease the amount and increase the velocity of compressed air or other fluid that is needed for acting upon the surface 66 to be cleaned and for rendering the soil airborne, and then to be easily carried into the suction nozzle 40 and away. The tapered nature of the wind tunnels causes the compressed air or fluid to increase in velocity as it approaches the suction nozzle 40 for maximum efficiency of soil removal. As mentioned earlier, the second series of jet orifices 68 which generally overlie the first series 66 are directed generally rearwardly and horizontally so as to flush out the wind tunnels and avoid a rotating turbulent action and produce streamline motion of the air or other fluid flow toward the suction nozzle and out through the wand 20 of the vacuum cleaner machine.

Having described above a vacuum cleaner with a novel combination of suction nozzle means and a compressed air means having tapered wind tunnels joining the jet orifices to the suction nozzle means, it will readily be apparent to those skilled in this art that this invention could employ a pulsating compressed air or other fluid medium instead of a constant flow. Moreover, this invention could be incorporated into the vacuum hood of an upright vacuum cleaner, because it is not limited in its use to the floor attachment or power nozzle of a canister-type vacuum cleaner.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. Vacuum cleaning apparatus including hood means adapted to be supported on and movable along a surface to be cleaned and having an opening on its bottom side confronting the said surface to form therewith a traveling vacuum chamber, said apparatus comprising:

a. suction nozzle means located within the hood means and having an outlet that is connected to a vacuum source;

b. a jet stream manifold positioned generally across the hood means and being provided with a plurality of orifices which are directed at a flat angle toward the said surface to be cleaned;

c. a low ceiling plate connecting the jet stream manifold with the suction nozzle means, and partitions suspended from the ceiling plate and positioned between adjacent orifices so as to form narrow wind tunnels connecting the jet stream manifold to the intake of the suction nozzle means;

d. and an electrically driven miniature compressor positioned above the low ceiling plate and provided with a conduit to deliver a compressed fluid to the jet stream manifold.

2. The invention as recited in claim 1, wherein the said plurality of wind tunnels are tapered inwardly from the jet stream manifold to the intake of the suction nozzle means for increasing the velocity of the jet stream.

3. The invention as recited in claim 2, wherein both the height and the width of the wind tunnels are tapered or reduced from the jet stream manifold to the intake of the suction nozzle means.

4. The invention as recited in claim 3 wherein the said jet stream manifold, the low ceiling plate as well as the suction nozzle means are all formed as a single molded plastic plate positioned within the bottom portion of the hood means, the jet stream manifold being positioned adjacent the front edge of the hood means, while the suction nozzle means is positioned adjacent the rear edge of the hood means.

5. The invention as recited in claim 1, wherein the said opening on the bottom side of the hood means exposes the bottom side of the plurality of wind tunnels as well as the intake of the suction nozzle means.

6. The invention as recited in claims 1, 2 or 5 wherein the said jet stream manifold, the low ceiling plate as well as the suction nozzle means are all formed as an integral unit in the bottom portion of the hood means to reduce the volume and increase the velocity of the compressed fluid which flows through the wind tunnels thereby resulting in increased efficiency of soil removal.

7. The invention as recited in claim 1 wherein the said hood means is a floor attachment of a canister-type vacuum cleaner, and the compressed fluid has a pulsating flow pattern.

* * * * *